US007854583B2

(12) United States Patent
Wichmann et al.

(10) Patent No.: US 7,854,583 B2
(45) Date of Patent: Dec. 21, 2010

(54) STATOR JOINING STRIP AND METHOD OF LINKING ADJACENT STATORS

(75) Inventors: Lisa Wichmann, Greenville, SC (US); Nick Martin, Simpsonville, SC (US)

(73) Assignee: Genral Electric Company, Schenectady, NY (US)

( * ) Notice: Subject to any disclaimer, the term of this patent is extended or adjusted under 35 U.S.C. 154(b) by 804 days.

(21) Appl. No.: 11/882,981

(22) Filed: Aug. 8, 2007

(65) Prior Publication Data

US 2009/0041580 A1 Feb. 12, 2009

(51) Int. Cl.
*F01D 9/04* (2006.01)

(52) U.S. Cl. ..... 415/1; 415/191; 415/208.2; 415/209.2; 415/209.3

(58) Field of Classification Search ..... 415/1, 415/191, 208.1, 208.2, 209.2, 209.4, 210.1; 416/1, 190, 191, 215, 216, 218, 220 R, 248
See application file for complete search history.

(56) References Cited

U.S. PATENT DOCUMENTS 3,326,523 A 6/1967 Bobo
4,014,627 A 3/1977 Heurteux
4,907,944 A * 3/1990 Kroger et al. ..... 415/65
5,022,818 A 6/1991 Scalzo
5,201,850 A * 4/1993 Lenhardt et al. ..... 416/190
5,259,727 A * 11/1993 Quinn ..... 415/190
5,429,479 A 7/1995 Cordier
5,601,407 A * 2/1997 Humhauser ..... 415/209.2
6,595,747 B2 * 7/2003 Bos ..... 415/209.4
6,984,108 B2 1/2006 Anderson et al.
7,618,234 B2 * 11/2009 Brackett et al. ..... 415/119

* cited by examiner

*Primary Examiner*—Igor Kershteyn
(74) *Attorney, Agent, or Firm*—Nixon & Vanderhye PC

(57) ABSTRACT

A compressor having a plurality of vane units each having at least one airfoil projecting from the base. Each base has a groove, so that when the vane units are disposed circumferentially adjacent, the grooves of the respective vane units are circumferentially aligned. A metal strip is disposed in the groove of a plurality of adjacent vane units to link the vane units forming a more rigid ring of vanes that are less susceptible to vane motion, e.g., caused by pressure fluctuations within the compressor of a gas turbine.

20 Claims, 4 Drawing Sheets

STATOR JOINING STRIP AND METHOD OF LINKING ADJACENT STATORS

BACKGROUND OF THE INVENTION

Compressor stator vanes in an industrial gas turbine are loaded and unloaded during start-stop cycles. In addition, the vanes are subject to small pressure fluctuations during operation. These result in relative motion between the vane and the casing in which the vanes are assembled. This causes the hook-fit on the stator base and the corresponding portion of the casing to wear and eventually could lead to fracture. Failure along part of the stator hook-fit causes tipping of the stator ring, creating a flow path other than that in the original design.

Previous solutions to this issue include a pinning method and a strapping method. The pinning method is disclosed in U.S. Pat. No. 6,984,108, the entire disclosure of which is incorporated herein by this reference. The pinning method uses a pin and hole method to link adjacent stators to form a rigid ring of stators. The strapping method, schematically illustrated in FIG. 1, provides a strap 10 that is bolted as at 12 to multiple stator bases 14, thereby creating a rigid ring segment 16. This fixing method has been used for over ten years.

BRIEF DESCRIPTION OF THE INVENTION

The invention provides a link between multiple stators to resist stator tipping in a tangential direction.

Thus, the invention may be embodied in a compressor comprising: a casing having at least one slot, the slot having a pair of side edges; a plurality of vane units disposed in said slot, each vane unit having a base and at least one airfoil projecting from the base, the base having a pair of mounting edges that are opposite each other and face said side edges, respectively, and a pair of engaging edges for engaging adjacent bases of adjacent vane units, a first groove extending along a first mounting edge of the base generally in parallel to a top surface of the base and aligned with a corresponding first groove of an adjacent vane unit base; and an elongated strip disposed in said first groove and having a length greater than a length of said mounting edge so as to be disposed in and extend along the first grooves of at least two adjacent vane units.

The invention may also be embodied in a method of linking adjacent stators, comprising: providing plurality of vane units, each vane unit having a base and at least one airfoil projecting from the base, the base having a pair of mounting edges that are opposite each other and a pair of engaging edges for engaging adjacent bases of adjacent vane units, a first groove extending along a first mounting edge of the base generally in parallel to a top surface of the base and aligned with a corresponding first groove of an adjacent vane unit base; and disposing an elongated strip in said first groove, said elongated strip having a length greater than a length of said mounting edge so as to be disposed in and extend along the first grooves of at least two adjacent vane units.

As such, the invention provides a solution to this rocking problem which has the particular advantage that it may be provided for stages that do not have room for a strap at the bottom of the stators.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
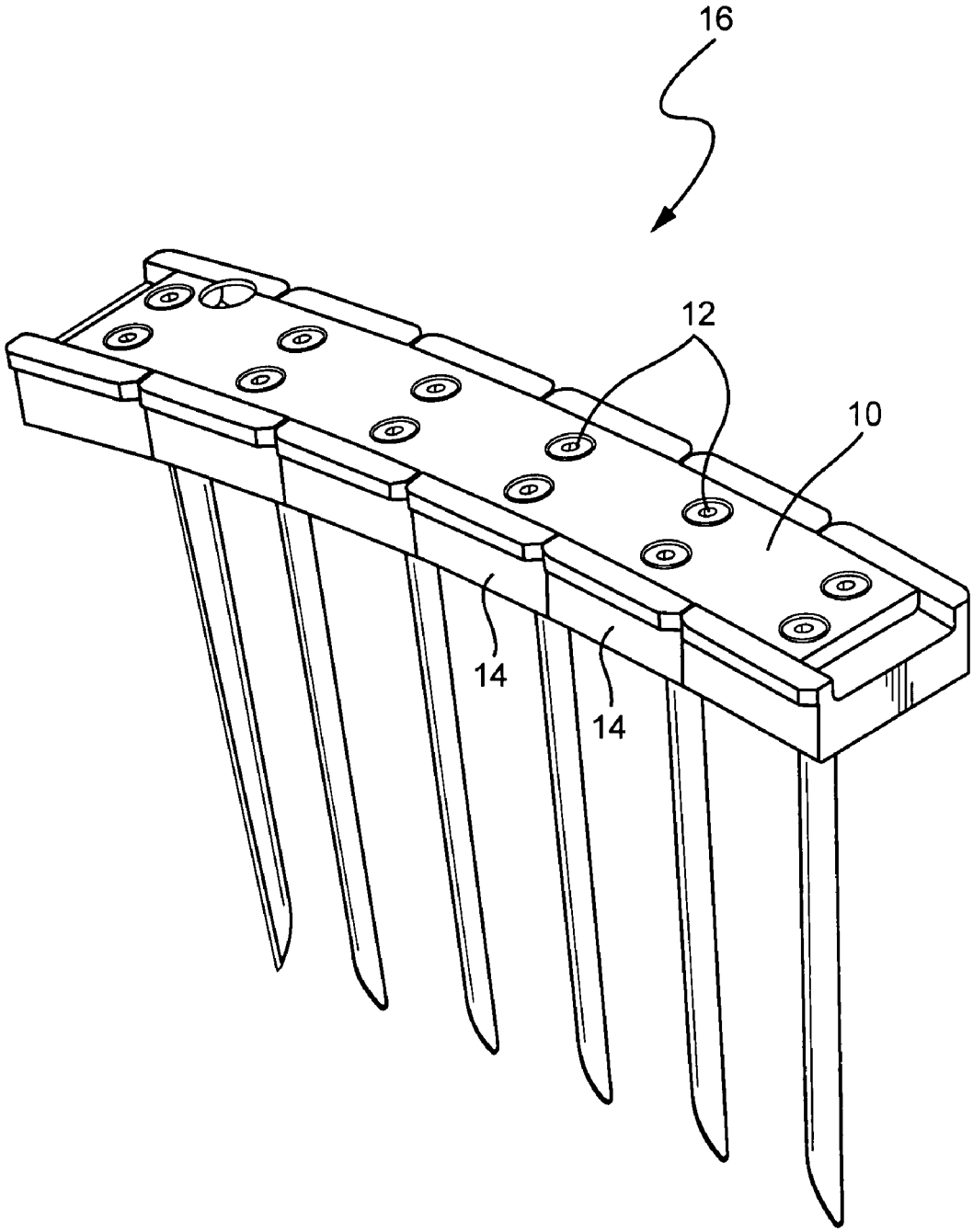
Fig. 1 (Prior Art)
FIG. 1 is a schematic perspective view from below showing a prior art strap method for adjoining adjacent stator vane units.

The invention provides a compressor stator vane unit and assembly wherein a link is provided between adjacent stator bases to reduce the likelihood of the stators rocking in the tangential direction. The resistance is created by transferring the outward radial force of one stator base to the inward radial force on the adjacent stator base. This resistance is transferred by the use of a metal strip which is set into a groove in the stator base. The stator base grooves are staked at each end of the set to prevent a link from shifting circumferentially.

Thus, an otherwise conventional stator base 64 is modified according to the invention to incorporate a groove spaced from the top of the base. A metal extrusion is slid into the groove of multiple adjoining stators. Then, as noted above, each end stator base is staked to prevent the metal extrusion from shifting. In the illustrated example embodiment, the groove is provided on only one side of the stator base to allow for extraction ports on the opposite side of the airfoil. In the absence of extraction holes, an adjoining strip may be provided on each axial side of the set of stator bases to further rigidify the stator segment. Thus, the adjoining strip provided according to an example embodiment of the invention not only links the adjoining stator units but creates a more rigid segment of stators around the circumference of the stage. The invention also provides a solution for stator rocking where stator bases with extraction holes are used.

Referring to the drawings in detail, there is illustrated a vane system including a vane unit in accordance with the present invention designated generally at 20.

Figure 2:
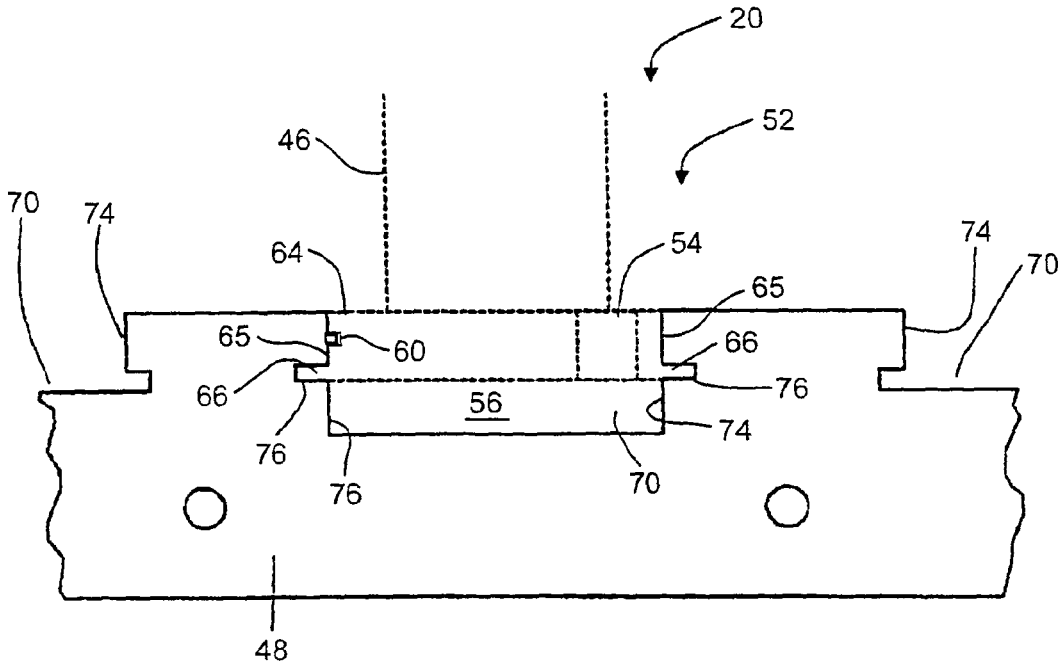
FIG. 2 is an enlarged view of the edge of a casing showing a stator stage embodying the invention.

The compressor vane unit 20, as seen in FIG. 2, has a base 64 from which the airfoil or the vane 46 projects. The base 64 has a pair of mounting edges 65 that are opposite each other and a pair of engaging edges 68 for engaging adjacent bases of the vane units 20. The base 64 of the vane unit 20 has a pair of projections 66 for securing to the casing 48, as discussed below, projection 66 extends from each of the mounting edges 65. The illustrated example vane units 20 have a base 64 with a hole 54 for drawing air into the air extraction cavity 56. In stages where an air extraction cavity is not provided, hole 54 is omitted. It is recognized that while each stage is similarly constructed, therefore, the individual compressor vane units 20 are sized for the respective stage and for factors such as curvature, clearance length, width and air extraction, if provided.

FIG. 2 illustrates an enlarged side view of the casing 48 showing an example stage 52. A plurality of the compressor vane units 20 are assembled in a slot 70 in the casing 48 to form the stator vane stage. The slot 70 has a pair of side edges 74 which have a groove or a pair of dove tails 76. The square base dove tail 76 holds the vane units 20 in place. Each vane unit 20 is allowed to slide into place with the base 64 received in the slot 70 and the projection 66 received in the groove 76.

However, according to the invention, a plurality of vane units are joined as an assembly prior to being received in slot 70 as discussed further below.

As mentioned above, the casing 48 in the embodiment shown has an air extraction cavity 56 that underlies the illustrated stage 52 and is formed by slot 70 and vane units 20. The air extraction cavity 56 draws air through hole 54 in base 64 of the vane unit 20 as seen in FIG. 2.

Figure 3:
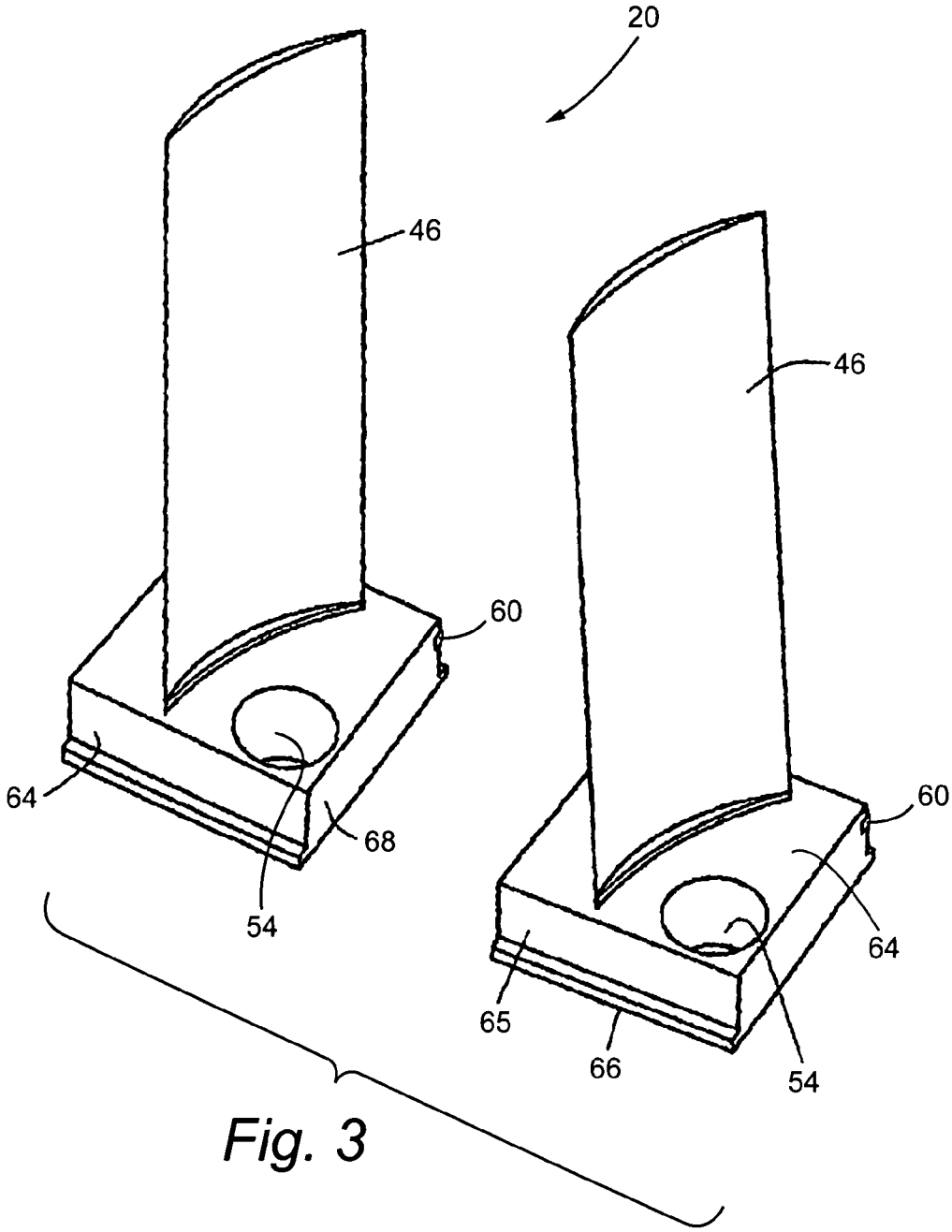
FIG. 3 is an exploded view of a pair of vane units embodying the invention.
Figure 4:
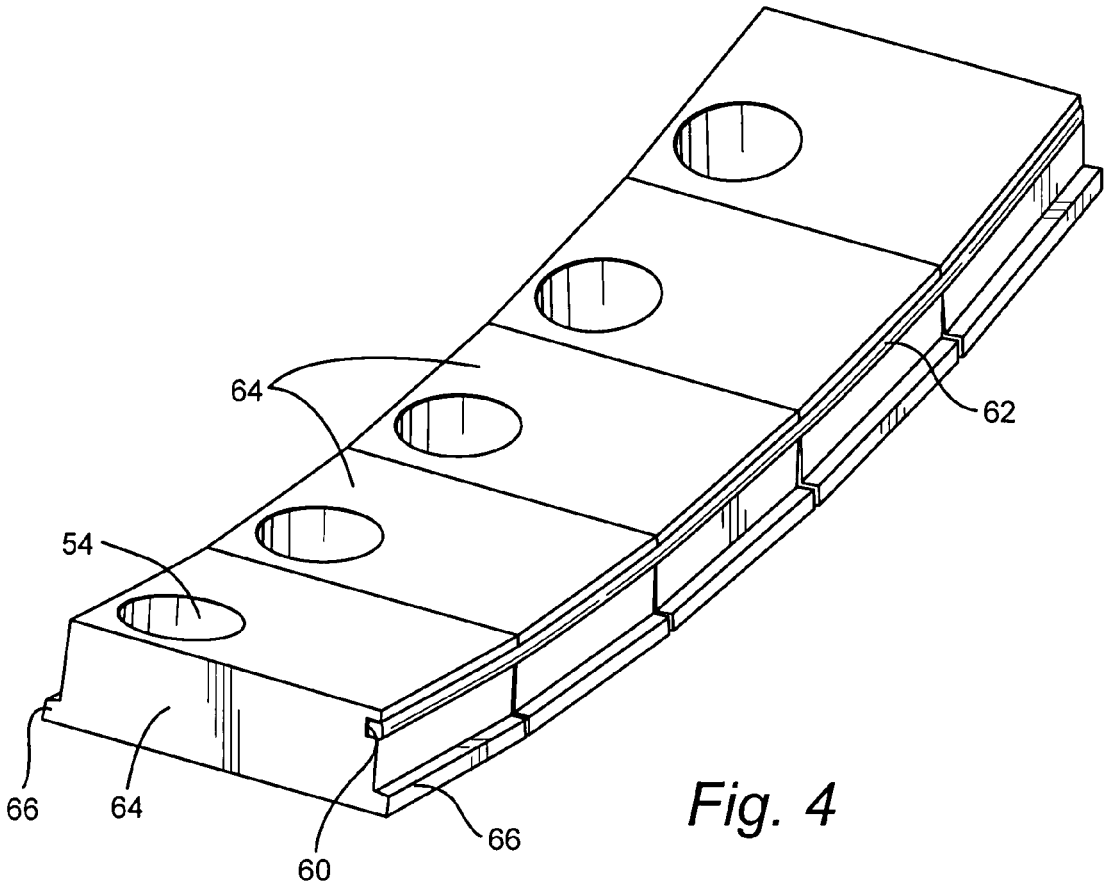
FIG. 4 is a side front perspective view of a plurality of vane units assembled together according to an embodiment of the invention, with airfoils omitted for ease of illustration.

The vanes in the prior art located above an air extraction cavity were more susceptible to relative tangential motion to the casing. This problem is addressed by the invention by providing a groove 60 along at least one side of the vane unit base as illustrated in FIGS. 2-4 for receiving a metal extrusion 62 to link a plurality of adjacent stator vane units. In FIG. 4, the vanes are omitted for clarity of illustration, but it is to be understood that the vanes are provided on the base as generally shown in FIGS. 2 and 3.

In addition, while the above is shown for vane units 20 having an single airfoil or blade 46, it is recognized that a unit may have a plurality of airfoils. The number of airfoils in a unit is dependent on the size and shape of the airfoil and the curvature of the casing 48.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor comprising:

a casing having at least one slot, the slot having a pair of side edges;

a plurality of vane units disposed in said slot, each vane unit having a base and at least one airfoil projecting from the base, the base having a pair of mounting edges that are opposite each other and face said side edges, respectively, and a pair of engaging edges for engaging adjacent bases of adjacent vane units, a first groove extending along a first mounting edge of the base generally in parallel to a top surface of the base and aligned with a corresponding first groove of an adjacent vane unit base; and an elongated strip disposed in said first groove and having a length greater than a length of said mounting edge so as to be disposed in and extend along the first grooves of at least two adjacent vane units, wherein an air extraction cavity is defined in said casing between said base and a bottom of said slot and wherein a hole is defined to said base for drawing air into said air extraction cavity.

2. The compressor of claim 1, wherein said elongated strip is fixed to an end of said first groove so as to be retained therein.

3. The compressor of claim 1, wherein said elongated strip is a metal extrusion.

4. The compressor of claim 1, wherein a second groove is defined in the other mounting edge of said base.

5. The compressor of claim 1, wherein said first groove is defined in the mounting edge most remote from said hole.

6. A compressor comprising:

a casing having at least one slot, the slot having a pair of side edges;

a plurality of vane units disposed in said slot, each vane unit having a base and at least one airfoil projecting from the base, the base having a pair of mounting edges that are opposite each other and face said side edges, respectively, and a pair of engaging edges for engaging adjacent bases of adjacent vane units, a first groove extending along a first mounting edge of the base generally in parallel to a top surface of the base and aligned with a corresponding first groove of an adjacent vane unit base; and an elongated strip disposed in said first groove and having a length greater than a length of said mounting edge so as to be disposed in and extend along the first grooves of at least two adjacent vane units, wherein each said side edge of said slot has a retention groove defined therein and wherein a retaining projection projects from each mounting edge of said base for engagement with a respective retention groove.

7. The compressor of claim 6, wherein an air extraction cavity is defined in said casing between said base and a bottom of said slot and wherein a hole is defined to said base for drawing air into said air extraction cavity.

8. The compressor of claim 7, wherein said first groove is defined in the mounting edge most remote from said hole.

9. The compressor of claim 6, wherein each said retention groove is spaced from a bottom surface of said slot so that when said vane unit is engaged with said grooves in said slot, a space is defined between a bottom of said vane unit and the base of the slot to define an air extraction cavity therebetween, and wherein a hole is defined to said base for drawing air into said air extraction cavity.

10. The compressor of claim 9, wherein said first groove is defined in the mounting edge most remote from said hole.

11. The compressor of claim 6, wherein said first groove is disposed on said mounting edge between said retaining projection and the top surface of the base.

12. A method of linking adjacent stators, comprising:

providing plurality of vane units, each vane unit having a base and at least one airfoil projecting from the base, the base having a pair of mounting edges that are opposite each other and a pair of engaging edges for engaging adjacent bases of adjacent vane units, a first groove extending along a first mounting edge of the base generally in parallel to a top surface of the base and aligned with a corresponding first groove of an adjacent vane unit base; and disposing an elongated strip in said first groove, said elongated strip having a length greater than a length of said mounting edge so as to be disposed in and extend along the first grooves of at least two adjacent vane units, further comprising:

providing a casing having at least one slot, the slot having a pair of side edges; and disposing said plurality of vane units in said slot so that said mounting edges face said side edges, wherein an air extraction cavity is defined in said casing between said base and a bottom of said slot and wherein a hole is defined to said base for drawing air into said air extraction cavity.

13. The method of claim 12, further comprising staking an end of said first groove so as to retain said elongated strip therein.

14. The method of claim 12, wherein said elongated strip is a metal extrusion.

15. The method of claim 12, wherein said first groove is defined in the mounting edge most remote from said hole.

16. A method of linking adjacent stators, comprising:

providing plurality of vane units, each vane unit having a base and at least one airfoil projecting from the base, the base having a pair of mounting edges that are opposite each other and a pair of engaging edges for engaging adjacent bases of adjacent vane units, a first groove extending along a first mounting edge of the base generally in parallel to a top surface of the base and aligned with a corresponding first groove of an adjacent vane unit base; and disposing an elongated strip in said first groove, said elongated strip having a length greater than a length of said mounting edge so as to be disposed in and extend along the first grooves of at least two adjacent vane units, further comprising:

providing a casing having at least one slot, the slot having a pair of side edges; and disposing said plurality of vane units in said slot so that said mounting edges face said side edges, wherein each said side edge of said slot has a retention groove defined therein and wherein a retaining projection projects from each mounting edge of said base for engagement with a respective retention groove.

17. The method of claim 16, wherein an air extraction cavity is defined in said casing between said base and a bottom of said slot and wherein a hole is defined to said base for drawing air into said air extraction cavity.

18. The method of claim 16, wherein each said retention groove is spaced from a bottom surface of said slot so that when said vane unit is engaged with said grooves in said slot, a space is defined between a bottom of said vane unit and the base of the slot to define an air extraction cavity therebetween, and wherein a hole is defined to said base for drawing air into said air extraction cavity.

19. The method of claim 18, wherein said first groove is defined in the mounting edge most remote from said hole.

20. The method of claim 16, wherein said first groove is disposed on said mounting edge between said retaining projection and the top surface of said base.

* * * * *